US010730328B2

(12) United States Patent
Kubota et al.

(10) Patent No.: US 10,730,328 B2
(45) Date of Patent: Aug. 4, 2020

(54) TAPE CARTRIDGE

(71) Applicant: SEIKO EPSON CORPORATION, Tokyo (JP)

(72) Inventors: Tomoyuki Kubota, Suwa (JP); Akihiro Shintani, Suwa (JP); Taishi Sasaki, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/559,412

(22) PCT Filed: Mar. 16, 2016

(86) PCT No.: PCT/JP2016/058404

§ 371 (c)(1),
(2) Date: Sep. 18, 2017

(87) PCT Pub. No.: WO2016/148212

PCT Pub. Date: Sep. 22, 2016

(65) Prior Publication Data

US 2018/0086123 A1 Mar. 29, 2018

(30) Foreign Application Priority Data

Mar. 19, 2015 (JP) ..... 2015-055825

(51) Int. Cl.

| | |
|---|---|
| ***B41J 11/58*** | (2006.01) |
| ***B41J 32/00*** | (2006.01) |
| ***B41J 17/32*** | (2006.01) |
| ***B41J 15/04*** | (2006.01) |
| ***B41J 3/407*** | (2006.01) |

(52) U.S. Cl.

CPC ..... *B41J 32/00* (2013.01); *B41J 3/4075* (2013.01); *B41J 15/044* (2013.01); *B41J 17/32* (2013.01)

(58) Field of Classification Search

USPC ..... 400/613.1

See application file for complete search history.

(56) References Cited

U.S. PATENT DOCUMENTS 5,595,447 A 1/1997 Takayama et al.
5,597,247 A 1/1997 Inakoshi et al.
(Continued)

FOREIGN PATENT DOCUMENTS

CN 102099196 6/2011
JP H08-058203 A 3/1996
(Continued)

*Primary Examiner* — Lam S Nguyen
(74) *Attorney, Agent, or Firm* — Foley & Lardner LLP

(57) ABSTRACT

A tape cartridge mounted to a tape printer having a printing head, includes a cartridge case, a platen roller that is housed in the cartridge case and fees an ink ribbon and a printing tape pressed between the platen roller and the printing head, a tape delivery port that is provided in the cartridge case and feeds the printing tape, which is fed by the platen roller and separated from the ink ribbon, to outside of the cartridge case, and a delivery guide that has a first guide section at a side of the printing head and a second guide section at a side of the platen roller, which extend from edges of the tape delivery port to inside of the cartridge case while spreading apart from each other, and guides a distal end of the printing tape into the tape delivery port.

9 Claims, 5 Drawing Sheets

(56) References Cited

U.S. PATENT DOCUMENTS

| | | | | |
|---|---|---|---|---|
| 5,788,387 | A | 8/1998 | Takayama et al. | |
| 5,853,254 | A | 12/1998 | Inakoshi et al. | |
| 5,857,788 | A * | 1/1999 | Gutsell | B41J 3/4075 400/613 |
| 6,126,344 | A | 10/2000 | Takayama et al. | |
| 6,386,774 | B1 | 5/2002 | Takayama et al. | |
| 6,491,460 | B1 | 12/2002 | Sodeyama et al. | |
| 10,000,071 | B2 | 6/2018 | Sasaki | |
| 10,118,404 | B2 | 11/2018 | Sasaki | |
| 2010/0329767 | A1 | 12/2010 | Sago et al. | |
| 2011/0008090 | A1 | 1/2011 | Yamaguchi et al. | |
| 2012/0008999 | A1 | 1/2012 | Yamaguchi et al. | |
| 2016/0271978 | A1 | 9/2016 | Sasaki et al. | |
| 2018/0022110 | A1 | 1/2018 | Sasaki | |
| 2018/0264844 | A1 | 9/2018 | Sasaki | |

FOREIGN PATENT DOCUMENTS

| | | | |
|---|---|---|---|
| JP | 2000-127538 | | 5/2000 |
| JP | 2002-137510 | A | 5/2002 |
| JP | 2014-184560 | | 10/2014 |
| JP | 2016-144875 | A | 8/2016 |
| WO | WO-2010/047154 | | 4/2010 |

* cited by examiner

TAPE CARTRIDGE

CROSS REFERENCE TO RELATED APPLICATIONS

This application is a national stage entry of PCT/JP2016/058404, filed Mar. 16, 2016; which claims priority to Japanese Application No. 2015-055825, filed Mar. 19, 2015; the disclosures of which are herein incorporated by reference in their entirety.

TECHNICAL FIELD

The present invention relates to a tape cartridge which receives a printing tape and is mounted to a tape printer.

BACKGROUND ART

In the related art, as this kind of tape cartridge, there has been known a tape cartridge including a tape core on which a printing tape (a label tape) is wound so as to be capable of being fed, a ribbon feeding reel on which an ink ribbon is wound so as to be capable of being fed, a ribbon winding reel that winds the ink ribbon fed from the ribbon feeding reel, and a cartridge case that houses these elements (see Patent Literature 1). In this tape cartridge, the cartridge case is formed at a sidewall thereof with a slit-like tape delivery port, and the printing tape is configured to be fed to the outside of the cartridge case from the tape delivery port.

CITATION LIST

Patent Literature

[Patent Literature 1]: JP-A-2014-184560

SUMMARY OF INVENTION

Technical Problem

It is general that this kind of tape cartridge is used in the state in which a distal end of the printing tape is always fed from the tape delivery port; however, in a tape printer mounted with the tape cartridge, there is a case where the distal end of the printing tape is pulled back into the cartridge case once, and then the distal end is fed to the outside from the tape delivery port again. For example, the distal end of the printing tape is pulled back to the position of the printing head positioned inside the cartridge case, so that it is possible to perform various types of printing with respect to the distal end portion of the printing tape.

However, in the aforementioned tape cartridge, there is a problem that the distal end of the printing tape is pulled back once, and then when the distal end is fed to the outside from the tape delivery port again, the distal end of the printing tape is close to the printing head side, is deviated from the tape delivery port, and thus does not enter the tape delivery port. That is, the printing tape adheres to the ink ribbon due to compression by the printing head and a platen roller. Therefore, there occurs force pulled to the ink ribbon side, that is, the printing head side with respect to the printing tape fed from the tape pressing position. There occurs a case where due to this force, the distal end of the printing tape is close to the printing head side, is deviated from the tape delivery port, and thus does not enter the tape delivery port.

As a consequence, the distal end of the printing tape pulled back once is not able to be normally fed to the outside from the tape delivery port.

Solution to Problem

The present invention provides a tape cartridge capable of reliably feeding the distal end of a printing tape pulled back into a cartridge case once to the outside from a tape delivery port.

A tape cartridge of the present invention is a tape cartridge mounted to a tape printer having a printing head and including a cartridge case, a platen roller that is housed in the cartridge case and feeds an ink ribbon and a printing tape pressed between the platen roller and the printing head, a tape delivery port that is provided in the cartridge case and feeds the printing tape, which is fed by the platen roller and separated from the ink ribbon, to outside of the cartridge case, and a delivery guide having a first guide section at a side of the printing head and a second guide section at a side of the platen roller, which extend from edges of the tape delivery port to inside of the cartridge case while spreading apart from each other, and introducing a distal end of the printing tape to the tape delivery port, wherein the first guide section of the delivery guide has a guide surface which is formed such that a separation distance from a virtual line is long at a leading-end section as compared with a base end section, the virtual line passing through a tape pressing position and a center of the tape delivery port.

In this case, preferably, the first guide section of the delivery guide is formed such that the leading-end section is positioned the virtual line side apart from the ink ribbon separated from the printing tape.

Preferably, the first guide section of the delivery guide is formed such that the leading-end section faces the ink ribbon separated from the printing tape.

According to these configurations, even though the distal end of the printing tape is close to the printing head side (the ink ribbon side) and is deviated from the tape delivery port, the distal end contacts with the guide surface of the front side guide section so as to be guided to the tape delivery port by force from the ink ribbon, so that the printing tape is fed from the tape delivery port. As described above, the distal end of the printing tape pulled back into the cartridge case once can be reliably be fed from the tape delivery port. In addition, a case where the distal end of the printing tape is pulled back into the cartridge case also includes a case where the distal end of the printing tape is pulled back into the cartridge case by vibration and the like at the time of transportation as well as a case where the distal end of the printing tape is reversely fed by the platen roller.

On the other hand, preferably, the second guide section of the delivery guide has a guide surface which is formed such that the separation distance from the virtual line is long at a leading-end section as compared with a base end section.

In this case, preferably, the second guide section of the delivery guide is formed such that the angle of an acute angle between an extension line of the guide surface and the virtual line is equal to or less than the angle of an acute angle between a normal line of an outer periphery of the platen roller, which passes through the center of the tape delivery port, and the virtual line.

Furthermore, preferably, the second guide section of the delivery guide is formed such that the leading-end section faces the outer periphery of the platen roller.

According to these configurations, even though the distal end of the printing tape is close to the platen roller side and is deviated from the tape delivery port, the distal end faces the guide surface of the second guide section so as to be guided to the tape delivery port, so that the printing tape is fed from the tape delivery port. As described above, the distal end of the printing tape pulled back into the cartridge case once can be reliably be fed from the tape delivery port.

Furthermore, preferably, the tape cartridge further includes protruding parts that protrude from the edges of the tape delivery port to the outside of the cartridge case.

According to the configuration, for example, at the time of holding and the like of the tape cartridge by a user, even though the distal end of the printing tape is pushed back to the inside of the cartridge case by his/her hands, the pushing-back of the distal end of the printing tape is obstructed by the protruding parts. Therefore, the distal end of the printing tape is not pushed back beyond the positions of the protruding parts. That is, the reliable existence position of the printing tape can be approximate to the cutting position by the tape cutter as much as possible. Therefore, in the tape printer in which the distal end detection of the printing tape is not performed, a space on the distal end side of a label to be created can be reduced as much as possible.

DESCRIPTION OF EMBODIMENTS

Hereinafter, with reference to the accompanying drawings, a tape cartridge according to an embodiment of the present invention and a tape printer mounted with the same will be described. The tape printer performs printing while feeding a printing tape and an ink ribbon from the mounted tape cartridge, cuts a printed part of the printing tape, and creates a label (a tape piece).

Figure 1:
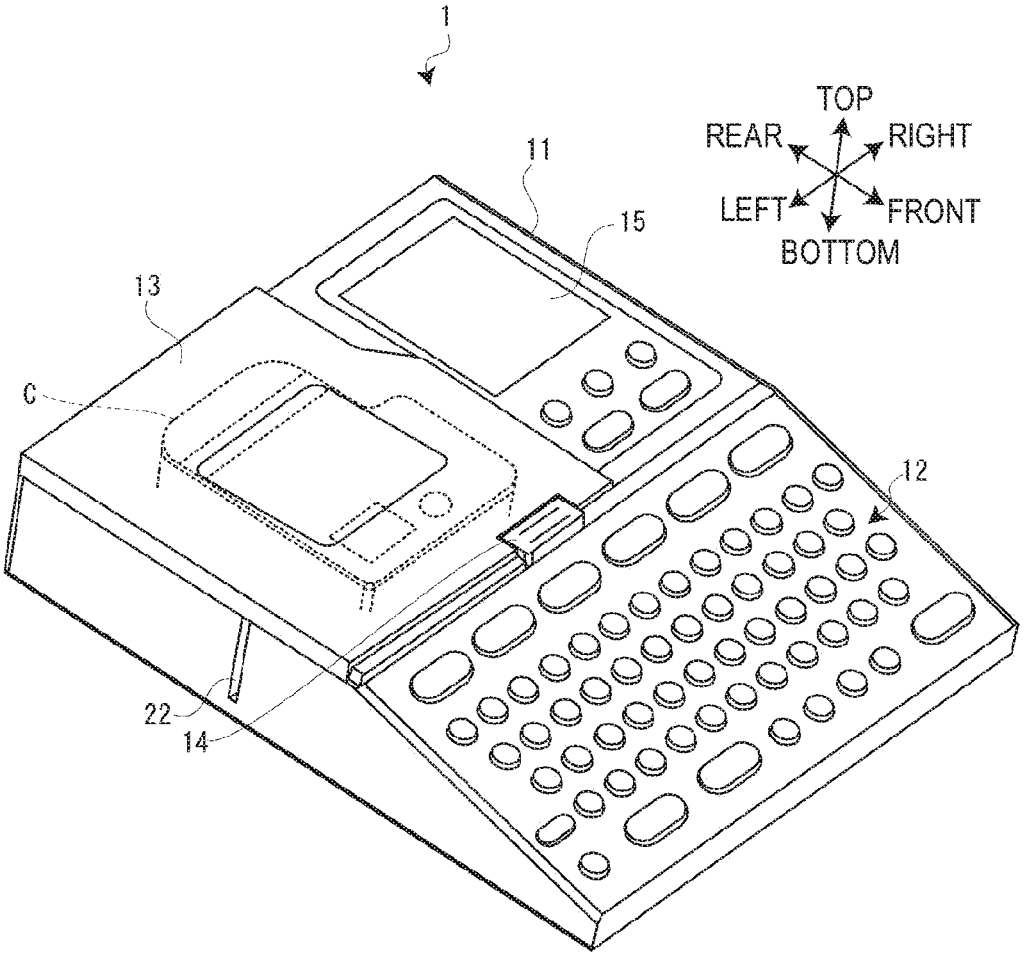
FIG. 1 is an external appearance perspective view illustrating a tape printer in a lid closed state according to the present embodiment.
Figure 2:
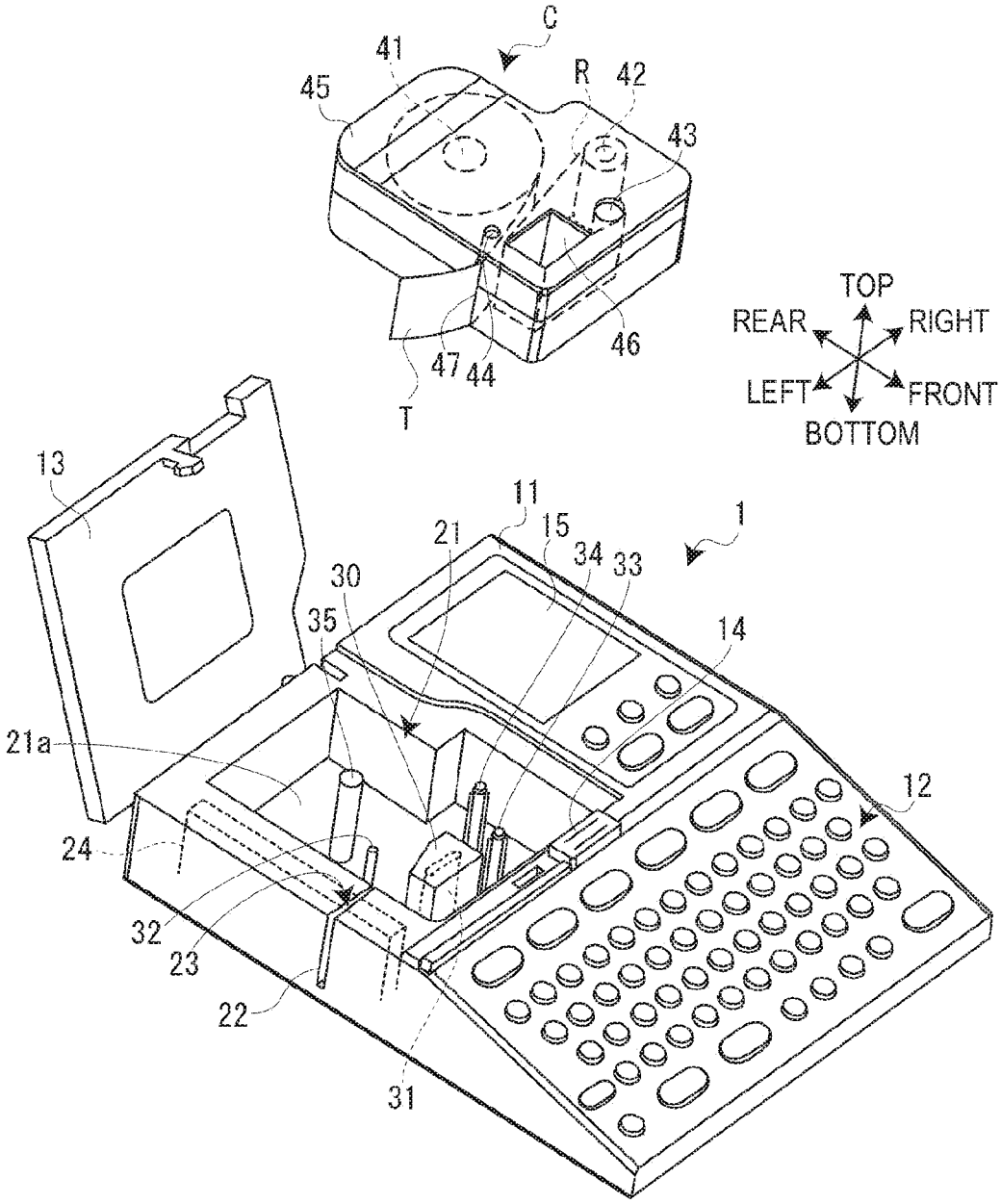
FIG. 2 is an external appearance perspective view illustrating a tape printer in a lid opened state.

As illustrated in FIG. 1 and FIG. 2, in a tape printer 1, an outer shell is formed by a device case 11 and a keyboard 12 including various keys is arranged on an upper surface of a front half part of the device case 11. An openable lid 13 is widely provided on a left upper surface of a rear half part of the device case 11, and at a front side of the openable lid 13, a lid opening button 14 is provided to open the openable lid 13. On a right upper surface of the rear half part of the device case 11, a rectangular display 15 is arranged to display an input result and the like from the keyboard 12.

When the lid opening button 14 is pressed to open the openable lid 13, a cartridge mounting part 21 is hollow-formed inside the openable lid 13 such that a tape cartridge C is freely detachable. The tape cartridge C is mounted to the cartridge mounting part 21 in the state in which the openable lid 13 has opened.

At a left side of the device case 11, a tape discharge port 22 connected to the cartridge mounting part 21 is formed, and between the cartridge mounting part 21 and the tape discharge port 22, a tape discharge path 23 is formed. Inside the device case 11, a tape cutter 24 is embedded to face the tape discharge path 23. The tape cutter 24 has a scissors type cutter structure, and has a fixed blade 25 and a movable blade 26 rotatably supported to the fixed blade 25 via a spindle (see FIGS. 4A to 4D). Between the fixed blade 25 and the movable blade 26, the fixed blade 25 is positioned to the cartridge mounting part 21 side.

Figure 3:
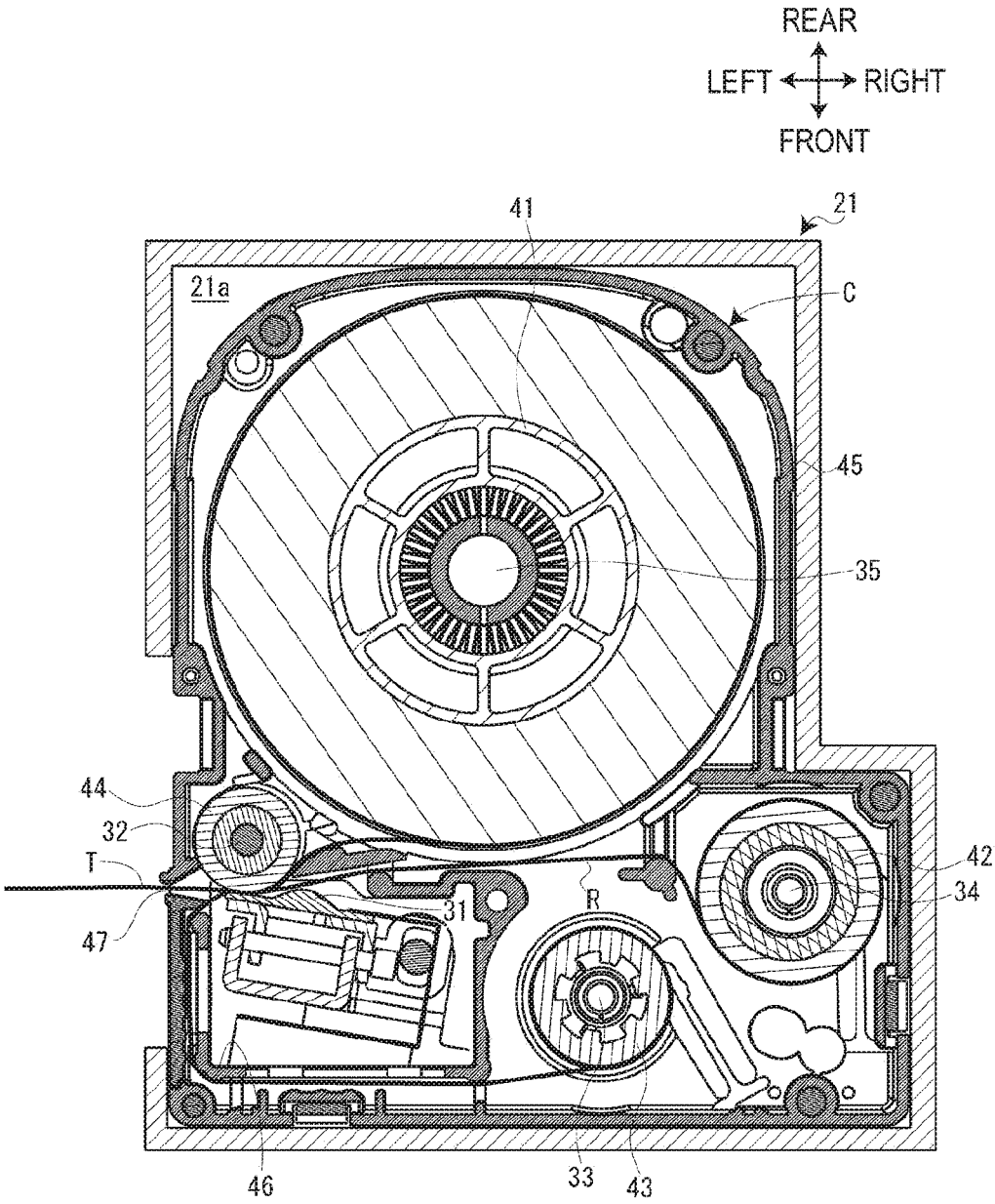
FIG. 3 is a plane sectional view illustrating a cartridge mounting part and a tape cartridge mounted to the same.

As illustrated in FIG. 2 and FIG. 3, the cartridge mounting part 21 is provided with a thermal type printing head 31 housed in a head cover 30, a platen driving shaft 32 facing the printing head 31, a winding-side driving shaft 33 fitted to a ribbon winding core 43 to be described later, a feeding-side driving shaft 34 fitted to a ribbon feeding core 42 to be described later, and a positioning protrusion 35 of a tape reel 41 to be described later. The platen driving shaft 32, the winding-side driving shaft 33, and the feeding-side driving shaft 34 pass through a bottom plate 21*a* of the cartridge mounting part 21, and in a lower space of the bottom plate 21*a*, a feeding power system is arranged to drive the platen driving shaft 32, the winding-side driving shaft 33, and the feeding-side driving shaft 34. FIG. 3 is a plane sectional view taken at the center position of the tape cartridge C in the up and down direction.

The printing head 31 is configured with a thermal printing head in which a plurality of heating elements (not illustrated) are vertically arranged in line. That is, the printing head 31 separately heat-drives the heating elements in the state of pressing a printing tape T and an ink ribbon R between the printing head 31 and a platen roller 44 to be described later, thereby thermally transferring ink on the ink ribbon R to the printing tape T in units of dots.

The tape cartridge C has the tape reel 41 winding the printing tape T, the ribbon feeding core 42 winding the ink ribbon R, the ribbon winding core 43 taking up the ink ribbon R, the platen roller 44 facing the printing head 31, and a cartridge case 45 receiving these elements. The cartridge case 45 is through-formed with a head opening 46 through which the head cover 30 is inserted. At a left sidewall of the cartridge case 45, a slit-like tape delivery port 47 is formed to feed the printing tape T to the outside of the cartridge case 45. Details of the surrounding of the tape delivery port 47 will be described later.

When the tape cartridge C is mounted to the cartridge mounting part 21, the head opening 46 is inserted around the head cover 30, so that the center hole of the tape reel 41 is inserted around the positioning protrusion 35. Simultaneously to this, the center hole of the platen roller 44 is fitted around the platen driving shaft 32, the center hole of the ribbon winding core 43 is fitted around the winding-side driving shaft 33, and the ribbon feeding core 42 is fitted around the feeding-side driving shaft 34.

The printing tape T is fed from the tape reel 41 inserted around the positioning protrusion 35, passes through a facing position between the printing head 31 and the platen roller 44, and then is fed to the tape discharge path 23 through the tape delivery port 47 (a tape feeding path). On the other hand, the ink ribbon R is fed from the ribbon feeding core 42 fitted to the feeding-side driving shaft 34, passes through the facing position between the printing head 31 and the platen roller 44, circularly moves a peripheral wall of the head opening 46, and then is wound around the ribbon winding core 43 fitted to the winding-side driving shaft 33 (a ribbon feeding path).

In contrast, the platen roller 44 fitted to the platen driving shaft 32 feeds the printing tape T and the ink ribbon R in a normal direction and a reverse direction by rotational driving while pressing the printing tape T and the ink ribbon R with the printing head 31. On the other hand, the ribbon winding core 43 fitted to the winding-side driving shaft 33 is rotationally driven in synchronization with normal feeding by the platen roller 44 to wind the ink ribbon R. Furthermore, the ribbon feeding core 42 fitted to the feeding-side driving shaft 34 is rotationally driven in synchronization with reverse feeding by the platen roller 44 to wind the ink ribbon R. In this way, the normal and reverse feeding operation of the printing tape T and the ink ribbon R is performed.

Hereinafter, with reference to FIGS. 4A to 4D, the label creation operation by the tape printer 1 will be described. In the present label creation operation, the printing tape T is reversely fed and is pulled back into the cartridge case 45, so that a label with no space due to a distance between the head and the cutter is created. Furthermore, it is assumed that the present label creation operation is performed from the state in which the distal end of the printing tape T is fed to the outside of the cartridge case 45 from the tape delivery port 47 (see FIG. 4A).

Figure 4A:
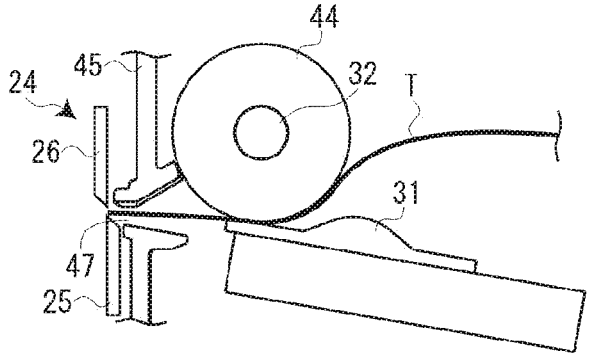
FIGS. 4A to 4D are explanatory diagrams for explaining a label creation operation by a tape printer.
Figure 4B:
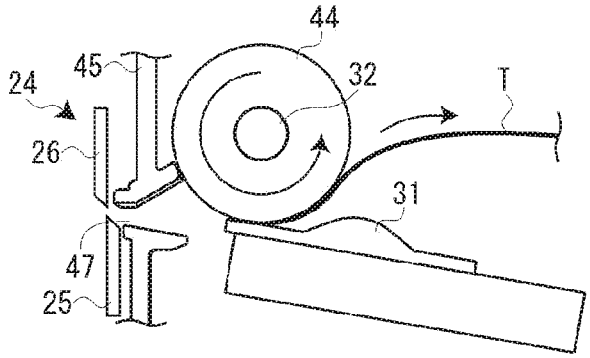

As illustrated in FIGS. 4A to 4D, in the present label creation operation, the platen roller 44 is reversely rotated (is rotationally driven in the counterclockwise arrow direction illustrated in FIG. 4B) to reversely feed the printing tape T, so that the distal end portion of the printing tape T is moved to a tape pressing position between the printing head 31 and the platen roller 44 (see FIG. 4B). That is, the distal end of the printing tape T is pulled back once, so that the distal end portion of the printing tape T is moved to a printing position by the printing head 31.

Figure 4C:
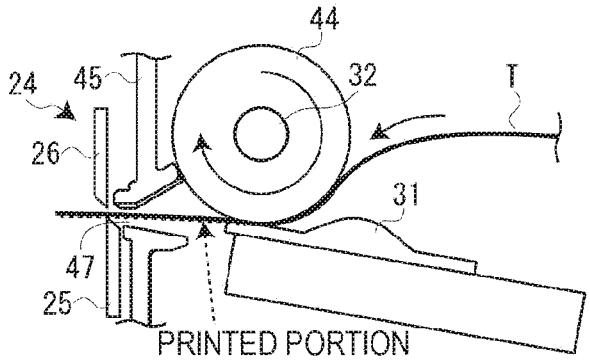

After the distal end portion of the printing tape T is moved to the printing position by the printing head 31, a printing process is performed (see FIG. 4C). That is, the platen roller 44 is normally rotated (is rotationally driven in the clockwise arrow direction illustrated in FIG. 4C) to normally feed the printing tape T, so that the printing head 31 is driven. In this way, the printing process is performed. By the normal feeding at the time of the printing process, the distal end of the printing tape T is fed from the tape delivery port 47.

Figure 4D:
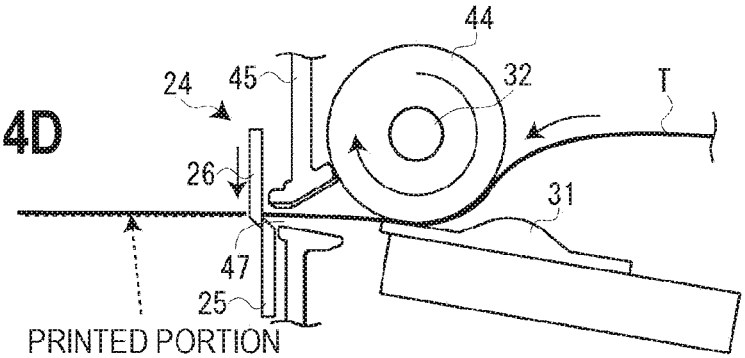

When the printing process is ended, a printed portion of the printing tape T is cut (see FIG. 4D). That is, the platen roller 44 is normally rotated to move the tail end of the printed portion of the printing tape T to a cutting position by the tape cutter 24, and then the tape cutter 24 is driven to cut the tail end of the printed portion. In this way, a label including a tape piece is created, so that the present label creation operation is ended.

Meanwhile, as described above, in the aforementioned label creation operation, the distal end of the printing tape T pulled back once is required to be fed from the tape delivery port 47. In this regard, in the present embodiment, the distal end of the printing tape T pulled back once can be reliably be fed from the tape delivery port 47 by the structure of the surrounding of the tape delivery port 47. Hereinafter, with reference to FIG. 5, details of the surrounding of the tape delivery port 47 will be described.

Figure 5:
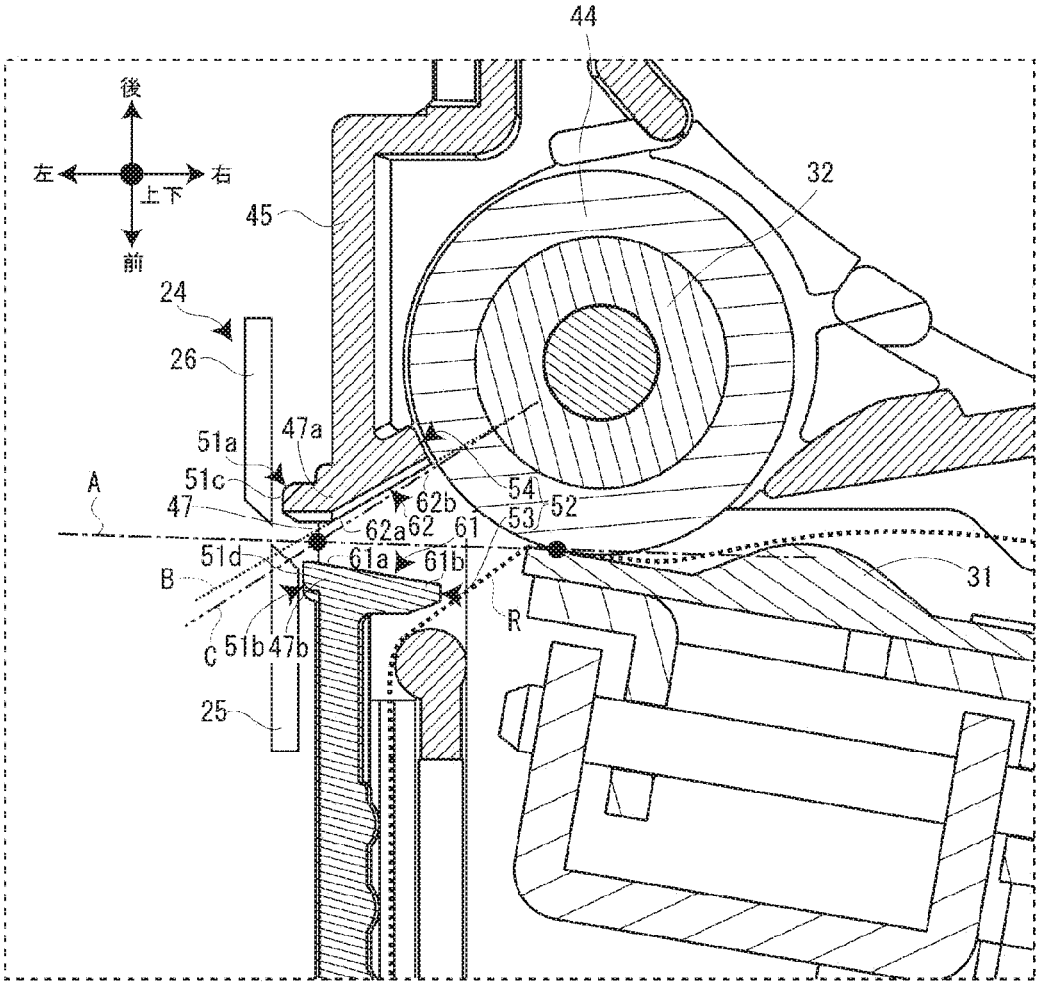
FIG. 5 is a plane sectional view of main elements illustrating the surrounding of a tape delivery port.

As illustrated in FIG. 5, the tape delivery port 47 is formed in a slit shape extending in the up and down direction at the left sidewall of the cartridge case 45, and feeds the printing tape T, which has been fed by the platen roller 44 and separated from the ink ribbon R, to the outside of the cartridge case 45. Rear and front edges 47*a* and 47*b* of the tape delivery port 47 are provided with a pair of rear and front protruding parts 51*a* and 51*b* protruding to the outside of the cartridge case 45, and a delivery guide 52 extending to the inside of the cartridge case 45. FIG. 5 is a plane sectional view of main elements taken at the center position of the tape cartridge C in the up and down direction, similarly to FIG. 3.

The pair of rear and front protruding parts 51*a* and 51*b* are formed to protrude to the outside (a feeding direction of the printing tape T when the platen roller 4 is normally rotated) of the cartridge case 45 from the rear and front edges 47*a* and 47*b* of the tape delivery port 47, and to protrude from the left sidewall of the cartridge case 45. Furthermore, the protruding parts 51*a* and 51*b* protrude such that the distal end portions 51*c* and 51*d* of the protruding parts 51*a* and 51*b* are approximate to the cutting position by the tape cutter 24 as much as possible. In the relation in which the fixed blade 25 near the tape delivery port 47 is positioned at a front side with respect to the tape delivery port 47, the protruding amount of the protruding part 51*b* protruding from the front edge 47*b* of the tape delivery port 47 is smaller than that of the protruding part 51*a* protruding from the rear edge 47*a* of the tape delivery port 47.

The delivery guide 52 has a front side guide section 53 (a first guide section) and a rear side guide section 54 (a second guide section) that extend from the edges 47*a* and 47*b* of the tape delivery port 47 to the inside of the cartridge case 45 while spreading apart from each other.

The front side guide section 53 is formed in an inclined shape of extending from the front edge 47*b* (the printing head 31 side) of the tape delivery port 47 to the inside (in the reverse feeding direction of the printing tape T when the platen roller 4 is reversely rotated) of the cartridge case 45 and introducing the distal end of the printing tape T to the tape delivery port 47. Specifically, the front side guide section 53 has a guide surface 61 that guides the distal end of the printing tape T. The guide surface 61 is formed such that a separation distance from a virtual line A is long at a leading-end section 61*b* as compared with a base end section 61*a* when the virtual line A is employed as a reference, wherein the virtual line A passes through the tape pressing position (a nip point) between the printing head 31 and the platen roller 44 and (a center point) of the tape delivery port 47. That is, the guide surface 61 makes an acute angle with respect to the tape feeding path from the aforementioned tape pressing position to the tape delivery port 47. In other words, at the time of the aforementioned normal feeding of the printing tape T, even though the distal end of the printing tape T is close to the front side and is deviated from the tape delivery port 47, the distal end of the printing tape T is configured to contact with the guide surface 61 so as to be guided to the tape delivery port 47.

Furthermore, the front side guide section 53 is formed such that the leading-end section 61*b* of the guide surface 61 is positioned at the virtual line A side apart from the ink ribbon R separated from the printing tape T and faces the ink ribbon R.

On the other hand, the rear side guide section 54 is formed in an inclined shape of extending from the rear edge 47*a* (the platen roller 44 side) of the tape delivery port 47 to the inside of the cartridge case 45 and introducing the distal end of the printing tape T to the tape delivery port 47. Specifically, the rear side guide section 54 has a guide surface 62 that guides the distal end of the printing tape T. The guide surface 62 is formed such that the separation distance from the aforementioned virtual line A is long at a leading-end section 62*b* as compared with a base end section 62*a*. That is, the guide surface 62 makes an acute angle with respect to the tape feeding path from the aforementioned tape pressing position to the tape delivery port 47. In other words, at the time of the aforementioned normal feeding of the printing tape T, even though the distal end of the printing tape T is close to the rear side and is deviated from the tape delivery port 47, the distal end of the printing tape T is configured to contact with the guide surface 62 so as to be guided to the tape delivery port 47.

Furthermore, the rear side guide section 54 is formed such that the angle of an acute angle between an extension line B of the guide surface 62 and the aforementioned virtual line A is equal to or less than the angle of an acute angle between a normal line C of an outer periphery of the platen roller 44, which passes through (the center point) of the tape delivery port 47 and the aforementioned virtual line A. Moreover, the rear side guide section 54 is formed such that the leading-end section 62*b* of the guide surface 61 faces the outer periphery of the platen roller 44.

According to the configuration of the aforementioned embodiment, since the front side guide section 53 is provided, even though the distal end of the printing tape T is close to the printing head 31 side (the ink ribbon R side) and is deviated from the tape delivery port 47, the distal end contacts with the guide surface 61 of the front side guide section 53 so as to be guided to the tape delivery port 47 by force from the ink ribbon R, so that the printing tape T is fed from the tape delivery port 47. Furthermore, since the rear side guide section 54 is provided, even though the distal end of the printing tape T is close to the platen roller 44 side and is deviated from the tape delivery port 47, the distal end contacts with the guide surface 62 of the rear side guide section 54 so as to be guided to the tape delivery port 47, so that the printing tape T is fed from the tape delivery port 47. As described above, the distal end of the printing tape T pulled back into the cartridge case 45 once can be reliably be fed from the tape delivery port 47.

Furthermore, the protruding parts 51*a* and 51*b* are provided, so that a reliable existence position of the printing tape T can be approximate to the cutting position by the tape cutter 24 as much as possible. That is, at the time of holding and the like of the tape cartridge C by a user, there is a case where the distal end of the printing tape T is pushed back to the inside of the cartridge case 45 by his/her hands. Therefore, in the tape printer 1 of the present embodiment in which the distal end detection of the printing tape T is not performed, when the distal end of the printing tape T is pulled back on the assumption that the distal end of the printing tape T exists in the aforementioned cutting position, any trouble occurs. For example, the distal end of the printing tape T is pulled back beyond the tape pressing position between the printing head 31 and the platen roller 44, resulting in printing failure. Thus, in this kind of tape printer 1, pulling-back should be performed by employing the reliable existence position of the printing tape T as a reference. However, if the reference position and the cutting position by the tape cutter 24 are separated from each other, when there is no pushing-back of the distal end of the printing tape T by a user, a large space occurs in a label to be created. In this regard, the aforementioned protruding parts 51*a* and 51*b* are provided, so that the reliable existence position of the printing tape T can be approximate to the cutting position by the tape cutter 24 as much as possible, and can be approximate to the reference position of the pulling-back and the cutting position by the tape cutter 24 as much as possible. Thus, a space on a label to be created can be reduced as much as possible.

The aforementioned embodiment has a configuration in which the front side guide section 53 and the rear side guide section 54 are formed over the whole area in the longitudinal direction of the tape delivery port 47; however, the front side guide section 53 and the rear side guide section 54 may be formed only in a part of the longitudinal direction of the tape delivery port 47. Furthermore, the protruding parts 51*a* and 51*b* are also similar.

Furthermore, in the aforementioned embodiment, both guide surfaces 61 and 62 of the front side guide section 53 and the rear side guide section 54 make an acute angle with respect to the virtual line A; however, one of the guide surfaces 61 and 62 may be formed to be parallel to the virtual line A and the other one of the guide surfaces 61 and 62 may be formed to make an acute angle with respect to the virtual line A.

REFERENCE SIGNS LIST

1: tape printer
31: printing head
44: platen roller
45: cartridge case
47: tape delivery port
47*a*, 47*b*: edge
52: delivery guide
53: front side guide section
54: rear side guide section
61: guide surface
61*a*: base end section
61*b*: leading-end section
A: virtual line
C: tape cartridge
R: ink ribbon
T: printing tape

The invention claimed is:

1. A tape cartridge mounted to a tape printer having a printing head, comprising:

a cartridge case;

a platen roller that is housed in the cartridge case and feeds an ink ribbon and a printing tape pressed between the platen roller and the printing head;

a tape delivery port that is provided in the cartridge case and feeds the printing tape, which is fed by the platen roller and separated from the ink ribbon, to outside of the cartridge case; and a delivery guide that has a first guide section at a side of the printing head and a second guide section at a side of the platen roller, which extend from edges of the tape delivery port to inside of the cartridge case while spreading apart from each other, and is configured to guide a distal end of the printing tape that has been pulled back into the cartridge case to the tape delivery port, wherein the first guide section of the delivery guide has a guide surface which is formed such that a separation distance from a virtual line is long at a leading-end section of the first guide section as compared with a base end section of the first guide section, the virtual line passing through a tape pressing position and a center of the tape delivery port, wherein the tape delivery port extends through an outermost sidewall of the cartridge case and the delivery guide is positioned in the outermost sidewall of the cartridge case.

2. The tape cartridge according to claim 1, wherein the first guide section of the delivery guide is formed such that the leading-end section of the first guide section is positioned to be closer to the virtual line than the ink ribbon separated from the printing tape.

3. The tape cartridge according to claim 1, wherein the first guide section of the delivery guide is formed such that the leading-end section faces the ink ribbon separated from the printing tape.

4. The tape cartridge according to claim 1, wherein the second guide section of the delivery guide has a guide surface which is formed such that the separation distance from the virtual line is long at a leading-end section of the second guide section as compared with a base end section of the second guide section.

5. The tape cartridge according to claim 4, wherein the second guide section of the delivery guide is formed such that an angle of an acute angle between an extension line of the guide surface of the second guide section and the virtual line is equal to or less than an angle of an acute angle between a normal line of an outer periphery of the platen roller, which passes through the center of the tape delivery port, and the virtual line.

6. The tape cartridge according to claim 4, wherein the second guide section of the delivery guide is formed such that the leading-end section faces the outer periphery of the platen roller.

7. The tape cartridge according to claim 1, further comprising:

protruding parts that protrude from the edges of the tape delivery port to the outside of the cartridge case.

8. The tape cartridge according to claim 1, wherein the leading-end section of the first guide section is portion extending inward to the tape cartridge.

9. The tape cartridge according to claim 1, wherein the platen roller is configured to reversely rotate to pull the distal end of the printing tape back into the cartridge case.

* * * * *